US005557811A

United States Patent [19]

Hoff

[11] Patent Number: 5,557,811

[45] Date of Patent: Sep. 24, 1996

[54] FREE-FLOATING MEANS AND METHOD FOR ROLLING POOL COVERS

[76] Inventor: David D. Hoff, 7184 Gibson Canyon Rd., Vacaville, Calif. 95688

[21] Appl. No.: 760,578

[22] Filed: Sep. 16, 1991

Related U.S. Application Data

[63] Continuation-in-part of Ser. No. 631,019, Dec. 17, 1990, abandoned, which is a continuation-in-part of Ser. No. 396,911, Aug. 18, 1989, abandoned.

[51] Int. Cl.[6] ..... E04H 4/10; B65H 75/10; B65H 75/40

[52] U.S. Cl. ..... 4/502; 242/388.1; 242/395; 242/407.1; 242/919

[58] Field of Search ..... 242/67.1 R, 100.1, 242/96, 68, 86.52, 86.1, 107.1, 107.11, 395, 395.1, 407, 407.1, 546.1, 918, 919, 388.1; 273/27; 4/502

[56] References Cited

U.S. PATENT DOCUMENTS

| | | | |
|---|---|---|---|
| 739,403 | 9/1903 | Eberle, Jr. | 242/96 |
| 1,270,188 | 6/1918 | Mochon | 242/96 |
| 1,322,604 | 11/1919 | Nuhring | 242/86.1 X |
| 1,599,966 | 9/1926 | Higgins et al. | 242/86.52 |
| 2,350,758 | 6/1944 | Hever . | |
| 2,396,451 | 3/1946 | Warkentin | 242/86.1 |
| 2,565,339 | 8/1951 | Anderson . | |
| 2,933,262 | 4/1960 | Fish | 242/86.1 |
| 3,425,646 | 2/1969 | Hollowell . | |
| 3,533,572 | 10/1970 | Sims | 242/68 |
| 4,281,802 | 8/1981 | Burley | 242/86.52 |
| 4,311,288 | 1/1982 | Galland | 242/86.5 R |
| 4,324,370 | 4/1982 | Guard et al. . | |
| 4,328,930 | 5/1982 | Kalendovsky . | |
| 4,407,027 | 10/1983 | Colon . | |
| 4,915,320 | 4/1990 | Neal | 242/96 |
| 5,107,552 | 4/1992 | Lavalliere et al. | 4/502 |

FOREIGN PATENT DOCUMENTS

| | | | |
|---|---|---|---|
| 2845411 | 4/1980 | Germany | 4/502 |
| 3023846 | 1/1982 | Germany | 4/502 |

*Primary Examiner*—John M. Jillions
*Attorney, Agent, or Firm*—Bryan Cave LLP

[57] ABSTRACT

In accordance with the first embodiment of the invention, a first and second tube body is provided, the first tube body resting upon the upper surface of the cover, the second tube body beneath the cover. The first and second tube bodies are plugged together at the ends to form a tubular spindle-core apparatus which is extended to traverse a buoyant flexible pool cover utilizing the buoyancy of the cover to be free-floating with the cover upon the surface of the water and within the perimeter of the pool. In the second embodiment, a single tube body which is octagonal is provided as a spindle-core to be secured upon a buoyant flexible pool cover utilizing clips of similar geometric shape where the octagonal spindle-core shape provides a seating for clipping the buoyant flexible cover to the spindle-core. In all cases the spindle-core is positioned within the pool to a desired location intermediate the ends of the pool cover being traversed, the apparatus being sufficiently supported by the buoyancy of the flexible pool cover and is independent of any other structure for support other than the pool cover upon the surface of the water. In accordance with the method, the operator lifts one end of the spindle-core apparatus and engages the crank handle by plugging the handle into the end, then rolling the buoyant cover on the surface of the water, both ends of the cover simultaneously being drawn into a roll by action of the cover folding back onto itself as the spindle-core is rotated by the operator. Unrolling is effected by positioning the ends of the cover off the roll upon the water, the operator rotating the roll in the opposite direction as the rolling operation, while both ends of the cover simultaneously glide outward upon the surface of the water to a fully extended position.

11 Claims, 2 Drawing Sheets

FIG. 1
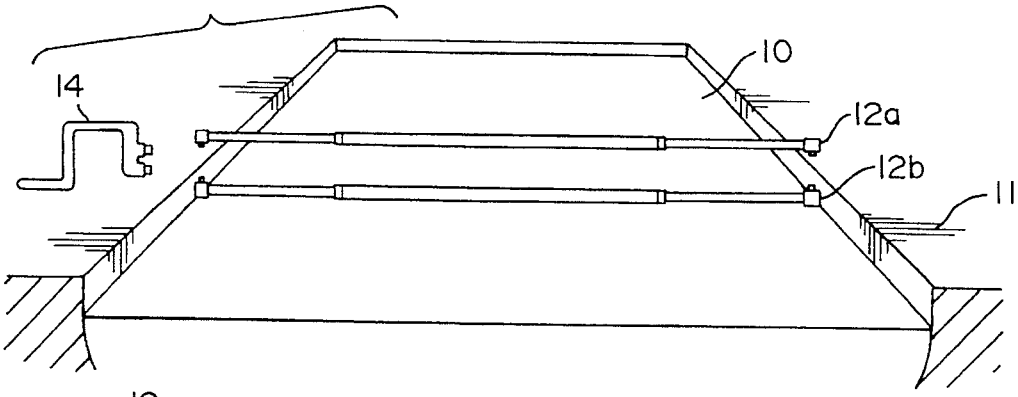
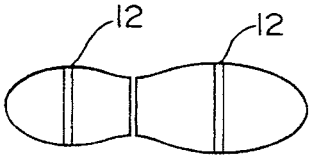
FIG. 2A
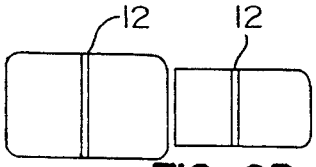
FIG. 2B
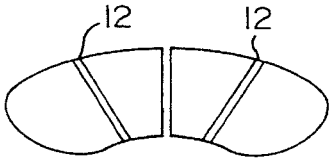
FIG. 2C
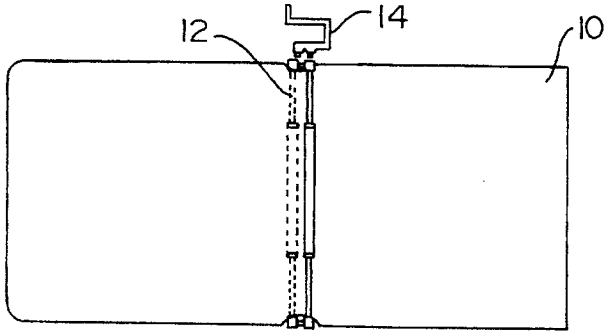
FIG. 3
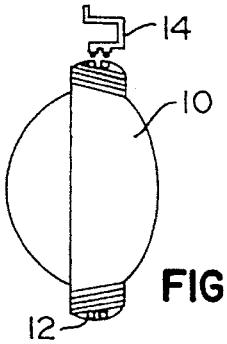
FIG. 4
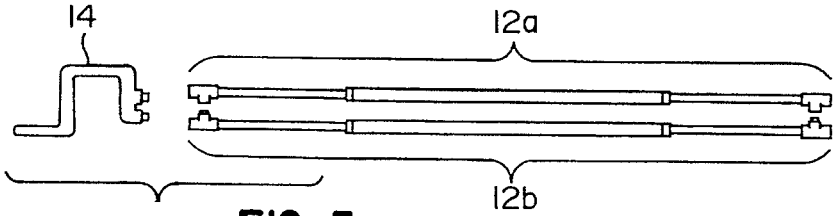
FIG. 5

FIG. 6A
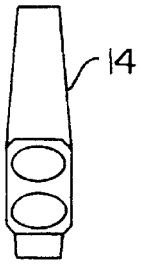
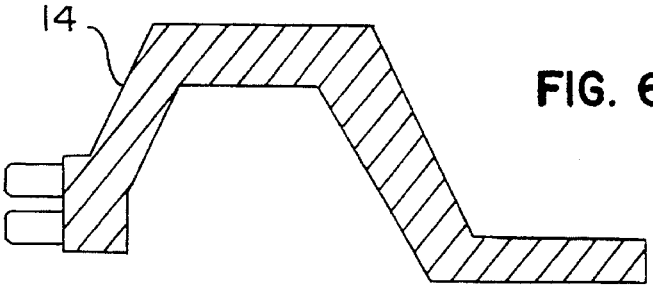
FIG. 6B
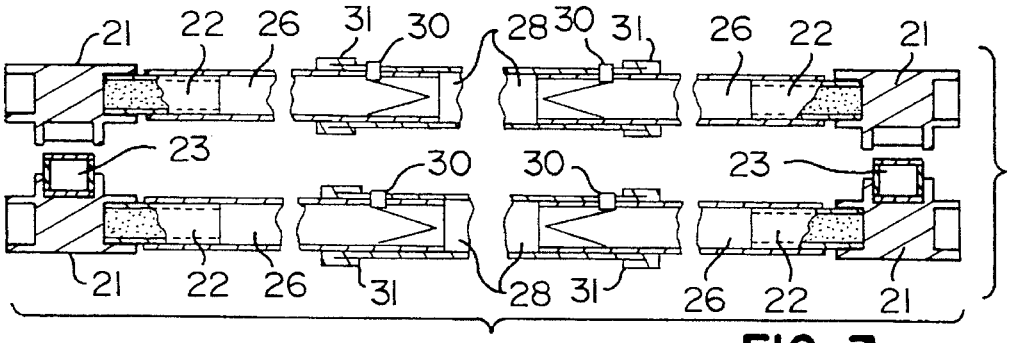
FIG. 7
FIG. 8A
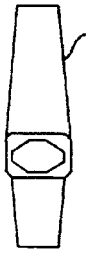
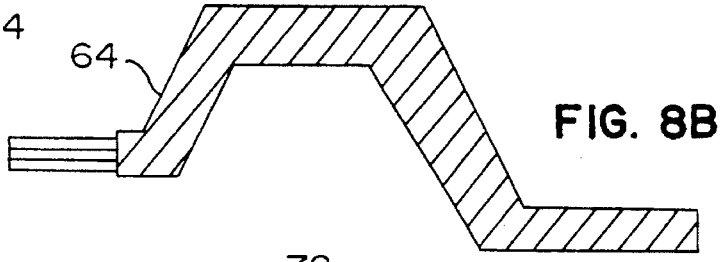
FIG. 8B
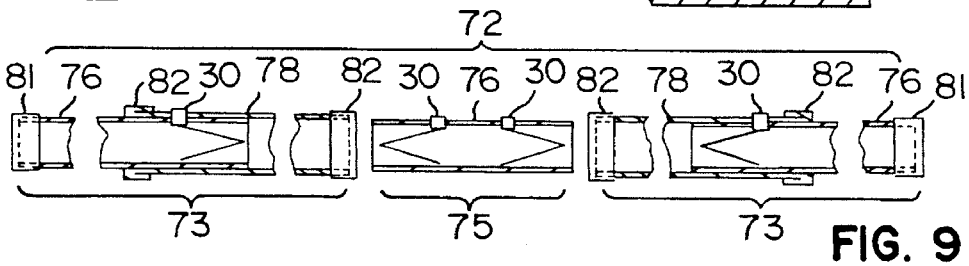
FIG. 9
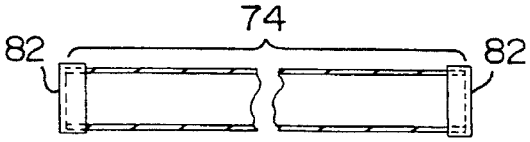
FIG. 10
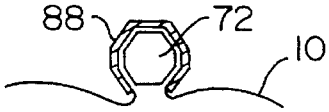
FIG. 11

FREE-FLOATING MEANS AND METHOD FOR ROLLING POOL COVERS

This is a continuation-in-part of application Ser. No. 07/631,019, filed Dec. 17, 1990, now abandoned, which was a continuation-in-part of Ser. No. 07/396,911, filed on Aug. 18, 1989, now abandoned.

BACKGROUND OF THE INVENTION

1. Technical Field

The present invention relates to a method and light-weight free-floating apparatus for rolling and un-rolling buoyant flexible swimming pool covers directly upon the surface water of the pool and within the perimeter of the pool edge, where the apparatus is secured upon the cover, midpoint of the cover, where also the apparatus is supported solely by the buoyancy of the flexible, pool cover.

2. Background Art

Buoyant flexible swimming pool covers are often cumbersome to handle when removing from and replacing to the surface water of the swimming pool. Typically this problem is overcome by the use of a reeling device which is supported by structures at the opposing ends of the spindle-core, where such structures are located beyond the perimeter of the swimming pool.

An example of such a device is illustrated in U.S. Pat. No. 4,328,930 to Kalendovsky which discloses a composite reel member on which the cover is rolled as it is removed from the surface of the swimming pool water to a storage position. This method of removal requires a pair of supporting stands to each of which one end of the spindle-core member is journaled. The reel itself also requires on each end a hub member having an axle which is received in a bearing carried by each stand. To one end is attached a crank handle to provide rotation of the reel upon the axle. To remove the buoyant flexible pool cover from the surface water of the pool requires the cover to be fastened to the take-up reel. Removal is then facilitated by drawing the cover up off the surface water of the pool and onto the reel in a rolled fashion.

Other examples would include U.S. Pat. No. 4,324,370 to Feher and Guard Products, and U.S. Pat. No. 4,407,027 to Colon, of which both products are currently marketed in the pool industry. Problems associated with reeling devices which rely upon structural supports at opposing ends of the spindle-core are numerous and suffer from a number of disadvantages:

(a) Devices are restricted to mounting; end supports beyond the perimeter of the swimming pool water, requiting the roll to be elevated above the surface water of the pool during the rolling operation. Elevation of the roll above the water: (1) temporarily suspends the cover between the surface water of the pool and the reel in an inclined manner while rolling and un-rolling the cover from the reel. During this time winds can get under the cover causing the cover to billow and wrinkle. When rolling the cover, wrinkling creates a bulky roll of the cover upon the reel, making the rolling process more difficult, and increases the time to properly roll the cover smoothly onto the reeling device. When un-rolling the cover, the presence of winds, can lift and billow the cover as winds get under the cover making it difficult for the cover to lay on the surface water of the pool and increases the time to finish the un-rolling task. (2) is objected to by many consumers because of the unsightliness of the reeling device mounted above the water which the device also creates an obstruction and hazard to the swimming pool area.

(b) The foregoing types of reeling devices are also complex, containing parts which wear out such as bearings, and attachments for the cover, all of which add to the initial cost of the device, and the cost to maintain the device in proper working order.

In addition, the most common method employed by the industry today entails placement of the roll at the end of the pool. It would otherwise be difficult to move the roll out of the way when the pool was in use. Placement of the reel at the end of the pool suffers from the following limitations and difficulties:

(c) Many swimming pools are often irregular in shape, having bottlenecks in the design. To remove the cover when the reeling device is located at the end of the swimming pool requires drawing the cover onto the reel through the irregular shapes and bottlenecks. This causes the cover to scrape against the side decking and restricts the passage of the cover in the direction of the reel and also creates undue wear and tear upon the cover as the cover scrapes against the decking of the swimming pool. In addition, the restriction adds an opposing resistance in the rolling direction, slowing the time to complete the task.

(d) Ell shaped or severe kidney shaped swimming pool designs are also a problem for reeling devices when the body of the cover bends outside the bounds of the reel width. To draw the entire cover onto the reel requires offending shapes to be squared off to the width of the reel, otherwise the cover will extend past the end of the reel when rolled. To square off a cover requires the offending wide parts of the cover to be folded back onto the non-offending body of the cover. To accomplish this extra step adds to the time to complete the rolling task. Folding back the cover also increases the thickness of the cover in a non-uniform manner, promoting bulkiness and unsightliness to the roll.

(e) Rolling the cover squarely onto the reel is another major problem with the device located at the end of the pool. Unless the cover is rolled squarely onto the reel, the cover will creep in a spiral manner to one side of the reel, and drag against the reel support stand. This drag not only increases the time and effort to turn the reel upon the reel axle, but also creates wear and tear upon the cover material as it rubs against the stand. To accomplish this task properly, the reel must initially be square to the cover, and must be kept square throughout the rolling process. If the support stands of the reel are not anchored in some manner to the deck or pool, the reel can move, failing to maintain squareness to the cover throughout the rolling process. Related to subparagraph (c) above, while drawing the cover onto the reel, bottlenecks in the pool design can cause the cover to tug against the reel, in an opposing direction, causing the reel to move.

The inventive concept of rolling and winding materials from a midpoint is known in the art as for example, Heuer U.S. Pat. No. 2,350,758, Anderson U.S. Pat. No. 2,565,339, and Hollowell U.S. Pat. No. 3,425,646. However, these devices are not "free-floating" as within the scope of this pool cover rolling device, and all rely upon anchoring of at least one end of the material, which is relieved within the aquatic environment of the present invention. Furthermore, the case of the Hollowell device requires a slack tensioner, and consequently could not be used to satisfy the requirement of the present invention which is to provide a light-weight free-floating tubular spindle-core for rolling buoyant flexible pool coverings directly upon the surface water of the pool without the need; for additional structural elements as sited in the prior art.

SUMMARY OF THE INVENTION

The apparatus presented as the present invention is designed to provide a light-weight, cost effective and simplified structure, for rolling and un-rolling buoyant flexible pool covers which eliminates the need for additional structural elements external to the perimeter of the pool edge.

In the first embodiment of the invention, the "spindle" portion, referred to as the spindle-core, is comprised of two parallel tube bodies plugged together at opposing ends. The composite spindle-core is separated enough to allow insertion of the buoyant cover between the two parallel bodies such the tube bodies traverse the top and under surface of the cover respectively, the, spindle-core being supported solely by the buoyancy of the pool cover. The first tube body acts as the core member, whereas the second tube body is employed as a means to secure the core member upon the buoyant flexible pool cover to: 1) prevent the core member from falling down into the water; 2) promote take-up of the cover upon the spindle-core. In the process of rolling the pool cover upon the spindle-core, the tube bodies rotate about an imaginary third axis exerting an even pressure in a similar rotational direction against the top and under surface of the sheet respectively to fold the cover back onto itself about the composite spindle-core directly upon the surface water of the pool. The spindle-core is telescopic in design to be expandable to the width of the pool. Each tube body consists of multiple elements; a center element and two end elements. The center element has an inside diameter larger than the outside diameter of the end element. This allows each end element to slip inside the center element to be assembled and promote variable lengths of the composite spindle-core. A locking mechanism is provided to prevent further telescoping once the desired length is established within the perimeter of the pool.

In the second embodiment of the invention, the "spindle" portion utilizes a single tube body design that traverses the cover as in the first embodiment at a midpoint of the cover. However, in the second embodiment, clips are used as a means for securing the spindle-core to the pool cover. To roll the cover upon the spindle-core, the second embodiment uses the same inventive concept as in the first embodiment to fold the cover back onto itself directly upon the surface water of the pool. The spindle-core is constructed of light-weight telescopic design, and utilizes a locking mechanism to lock the spindle-core to the desired length. In addition, the tubular spindle-core has an octagonal cross-sectional shape that interlocks the telescopic elements preventing inner-rotational slippage of the assemblage.

The end of the spindle-core is adapte, d to provide engagement of a crank handle. The crank handle is shaped in a way to allow one person to easily turn the spindle-core to roll the buoyant flexible pool cover directly upon the surface water of the pool, the operation being solely supported by the buoyancy of the cover and assisted by the buoyancy of the cover, where in combination with the fluid environment completely eliminates the additional need for bearings and support structures external to the spindle-core element. In the first embodiment, a double plug is used to engage the handle to the spindle-core. In the case of the second embodiment, the tubular spindle-core having an octagonal cross-sectional shape, provides an interlocking receptacle for the handle element to be removably received within the spindle-core end.

The roll, being solely supported by the buoyancy of the cover upon the water, can easily be maneuvered by a single person (because of the fluid environment) to remain in the pool off to the side and parallel to the pool edge, drawn up onto the pool decking, or because of the light-weight semi-rigid structure, can be easily balanced in ones hands to be removed entirely from the pool area. To eliminate the excess weight of trapped water from within the roll, which otherwise adds undesired weight, one end of the semi-rigid roll can be elevated to quickly drain off trapped water from within, thereby making the roll light-weight and more manageable.

Objects and Advantages

It is an object of the present invention to provide a flee-floating alternative to the aforementioned reliance upon support stands and other operative elements and provide an improved means for rolling and un-rolling buoyant flexible pool covers. Several advantages of the present invention are that the device:

(a) utilizes the buoyancy of the pool cover for support to float on the surface water of the pool within the perimeter of the pool therefore: (1) is not effected by winds during the rolling and un-rolling process thereby being extremely fast, easy, and uncomplicated to operate; (2) provides a neat, clean appearance and is not an obstruction or hazard to the pool area when not in use.

(b) is uncomplicated requiring no bearings or reliance upon other operative elements other than the crank handle, requires less maintenance to own, and thus is of lower cost to the consumer.

In addition, the present invention overcomes the restriction compelling typical reeling devices to be located at the end of the pool thereby:

(c) providing an improved means for removing covers from irregular shaped swimming pools which also suffer from the restriction bottlenecks pose while drawing the cover upon the surface water of the pool;

(d) providing an improved means for removing covers from ell shaped or severe kidney shaped swimming pools where covers are often wider than the roll width;

(e) providing an improved means for rolling a cover squarely onto a rolling device.

Moreover, further objects and advantages are to provide a light-weight device which: is uncomplicated to install, and is fast and easy to operate; because of the semi-rigid structure, provides an improved means for balance in one hands, and an improved means for eliminating trapped water from inside the roll, making the roll easy to handle; provides an improved mean for handling the cover in independent sections by segmenting the cover at bottlenecks in the pool thereby rolling shapes individually which (1) reduces the size and weight of each roll for handling by the consumer, (2) can roll irregular shapes independently to overcome bottlenecks as stated above; is easy to store in the off season; is fast and easy to remove from the cover and disassembles easy for storing back in the original package; is inexpensive to manufacture; is lightweight and compact for packaging which (1) requires a minimal storage space for stocking by dealers, and (2) is inexpensive to ship. Still further objects and advantages will become apparent from a consideration of the ensuing description and drawings.

DETAILED DESCRIPTION OF THE DRAWINGS

FIG. 1 is a perspective view of a pool showing the roller tube bodies traversing the cover in an exploded disposition with crank handle suspended to the side in a dramatic representation.

FIGS. 2A, 2B and 2C present various arrangements of multiple tube spindles illustrating the adaptability of the invention to irregular pool shapes.

FIG. 3 gives a perspective view of the roller with cover extended.

FIG. 4 shows perspective in FIG. 3 with cover rolled upon roller spindle-core.

FIG. 5 is a suspended elevational view of the entire apparatus alone.

FIGS. 6A and 6B present perspective of the first embodiment crank handle with double plugs.

FIG. 7 presents a detailed perspective of the composite spindle-core with cutaways to expose plugs to secure tube bodies together.

FIGS. 8A and 8B present perspective of the second embodiment crank with an octagonal cross-sectional shaped end.

FIG. 9 shows a second embodiment of the invention producing an octagonal cross-sectional shaped single tubular spindle-core.

FIG. 10 presents optional extension elements for the second embodiment.

FIG. 11 shows the clipping device for securing the octagonal cross-sectional shaped single tubular spindle-core to the pool cover.

DESCRIPTION OF PREFERRED EMBODIMENTS

Reference to FIG. 1 shows a general view of the preferred first embodiment with a first tube body indicated at 12*a*, a second tube body at 12*b*, a crank handle 14, suspended about a pool cover 10, with swimming pool perimeter shown at 11.

More than one spindle-core 12 is further shown generally disposed about various irregular shaped pools in FIGS. 2A, 2B and 2C where the pool cover 10 is segmented at the bend or bottleneck in the pool design to accommodate various irregular shapes of pools and the spindle-core 12 placed midway the ends of each segment of the pool cover 10.

In the first embodiment, the spindle-core 12 is comprised of two tube bodies, as shown in FIG. 5. Now referring to FIG. 7, each tube body, preferably of semi-rigid lightweight aluminum anodized to resist corrosion is comprised of two smaller diameter end elements 26, whereby to be telescopic, the ends of elements 26 are received within a larger diameter center element 28, allowing the spindle-core 12 to adjust to various widths of pools. The parallel tube bodies, 12*a* and 12*b*, are connected at opposing ends by tee fittings 21 adapted with a length of pipe 22 (fittings and pipe preferably of ¾ inch furniture grade PVC) to be received within the ends of elements 26 to form the composite spindle-core 12, the one fitting being adapted with a plug 23 to allow the two tube bodies to be plugged together at opposing ends about the pool cover. Furthermore, each tube body consists of two collars 31 positioned to shield the ends of the center tube 28, and two detent buttons 30 to lock the end tubes 26 into the center tubes at the appropriate length which when the spindle-core 12 is fully assembled also prevents rotational twist of each tube body about the other.

FIGS. 6A and 6B illustrate the crank handle 14, whereby plugging the handle into the end fittings 21 of the spindle-core 12 produces the ability to rotate the spindle-core 12 about an imaginary third axis to promote rolling of the cover 10 directly upon the surface water of the pool.

In the second embodiment of the invention, reference to FIG. 9 shows an octagonal cross-sectional shaped single tubular spindle-core 72, preferably of semi-rigid lightweight aluminum anodized to resist corrosion, comprised of extension members 73, which each are further comprised of a smaller diameter end element 76, to be received within a larger diameter center element 78, the ends of the elements 76 and 78 are shielded by preferably plastic collars 81 and 82 respectively. This design allows each extension member 73 to be telescopically adjustable and locked at the appropriate length utilizing detent buttons 30. Furthermore, each extension member 73 is butted together by means of a center butt 75 and also locked utilizing detent buttons 30 to comprise the composite telescopic spindle-core 72. Moreover, as shown in FIG. 10, optional extension elements 74 may be added between the extension members 73 utilizing the center butt 75 to incrementally expand the overall length of the spindle-core 72 whereby making the apparatus highly modular and compact in the disassembled state. Provided in FIG. 11 are multiple clipping devices 88 which are spread at the base and clipped over the cover 10 and spindle-core 72 in sufficient quantities to secure the spindle-core 72 to the buoyant flexible pool cover at sufficient intervals.

FIGS. 8A and 8B illustrates the crank handle 64 of the second embodiment, whereby engaging the handle 64 into the end of the spindle-core 72 produces the ability to rotate the spindle-core 72, rolling the cover 10 directly upon the surface water of the pool.

Installation and Method of Use

To install the spindle-core(s) upon the cover, placement of the spindle-core(s) is first determined as shown in FIGS. 2A, 2B and 2C. For irregular shaped pools, the cover should be segmented at the bottleneck of the pool, and as illustrated in FIGS. 2A, 2B and 2C the spindle-core(s) should traverse the widest part of each segmented shape at a midpoint of the shape where practical. For longer pools which have straight sides, covers may be segmented midway the ends to reduce the overall length of the cover whereby placement of the spindle-core(s) will traverse the cover segments mid-midpoint of each segment. Once placement is determined, a measurement is made of the width of the pool at this point.

In the case of the first embodiment, spindle-core(s) are adjusted to the required length in question by telescoping end sections 26 into or out of the center section 28. At the chosen length, a hole is then drilled to accept the detent button 30 and the spindle-core is then locked by insertion of the detent button locking device. Both tube bodies are further locked together by plugging end connectors together as illustrated in FIG. 7. The pool cover 10 is then slipped between the first and second tube bodies 12*a* and 12*b* to the chosen placement of the spindle-core, the whole of the spindle-core 12 being solely supported by the buoyant flexible cover 10 upon the surface water of the pool.

Once installed, the spindle-core 12 remains free-floating in the pool while the pool is covered, the entire spindle-core being continually supported by the buoyancy of the cover upon the water. To promote rolling and removal of the cover from the pool, one end of the spindle-core is raised slightly above the pool edge 11 to accept the crank handle 14. Once the handle is engaged, rolling is promoted by rotating the crank 14 and tube bodies 12*a* and 12*b* respectively about an imaginary longitudinal third axis parallel to the tube bodies of action emulating a rotisserie. This action applied to a midpoint of a cover draws the cover equally from both ends until cover is fully rolled upon the spindle-core.

The rolled cover can now be withdrawn from the pool by further inclining the semi-rigid roll to drain off excess water which otherwise adds undesired weight to the roll, the other end of the roll still being supported by the buoyancy of the cover on the water, the roll then being drawn up onto the pool deck, or because of the light-weight semi-rigid structure, can be easily balanced in ones hands to be removed from the pool area. Alternatively, it may be slid to the end of the pool, or rotated to the side and remain in the pool but out of the way. To return the cover to the extended position, placement of the roll to the original location within the pool is resumed. The roll is then rotated in the opposite direction to allow the ends of the cover to glide upon the surface water of the pool to a fully extended position.

In the case of the second embodiment, installation of the spindle-core 72 upon the cover 10 is much the same as the first embodiment, the difference being, the spindle-core 72 must be secured to the pool cover by means of the clips 88. The octagonal cross-sectional shape of the single tubular spindle-core 72 provides a seating for securing the spindle-core 72 to the pool cover 10 by means of multiple octagonal cross-sectional shaped clips 88 whereby the angular corners of the clips 88 seat the cover 10 to the same similar angular corners of the spindle-core, the same similar shape providing a seating for engagement of the crank handle 64 within the end of the spindle-core 72, the same shape providing a means to overcome rotational inner-slippage of the telescopic spindle-core elements. In addition, the employment of separate extension members 73 being coupled together by a center butt 75 produces a modular apparatus to provide easy handling of the device in the unassembled state. This modular design also utilizes extension elements 74 to incrementally increase the length of the overall spindle-core 72.

The operation of the second embodiment employs the same inventive concepts as the first embodiment for rolling and removal of the cover to a storage position, and replacing the cover again upon the pool, the variation being, the second embodiment uses a single "tube body" member to comprise the spindle-core 72 and rather than a second tube member, uses clips 88 to secure the spindle-core upon the pool cover to fold the cover back onto itself in a rolled fashion directly upon the surface water of the pool.

The expression "pool cover" used herein means a buoyant flexible pool covering having dimensions of the surface water which resides directly upon the surface water of the pool and is contained within the pool perimeter. The expression "free-floating" used herein refers to a spindle-core device which is independent of any structures for support other than the buoyant flexible pool cover resting upon the surface water of the pool.

The invention, which in the broader sense is not limited to swimming pools, may be applied to any application within an aquatic environment which necessitates the need to roll a buoyant flexible sheeting from a midpoint, for purposes to fulfill solutions not apparent herein.

The embodiments shown and described are only illustrative of the present invention and are not to be construed as being delimitive thereof. Such readily apparent changes, without patentable distinction, are illustrated by: a light-weight free-floating rotatable spindle-core comprising at least one traversing member comprising the length of the spindle-core, wherein the spindle-core is secured at a midpoint of the buoyant flexible sheeting to be rolled, wherein the process of rolling and un-rolling the sheeting is performed directly upon the surface of the water, wherein the buoyancy of the cover in combination with the fluid environment eliminates the reliance of the spindle-core upon bearings and end structures for support.

Hence, the present invention includes all modifications of structure encompassed within the spirit and scope of the following claims.

What is claimed is:

1. A free-floating apparatus for rolling buoyant flexible pool covers, said apparatus comprising:

(a) a tubular spindle-core element free-floating upon a buoyant flexible pool cover at a midpoint of said cover and within the perimeter of the pool, wherein said apparatus utilizes the buoyancy of said cover, is therein solely supported by the buoyancy of said cover, and is adapted to have said buoyant flexible pool cover wrapped therearound to roll said cover directly upon the surface water of the pool;

(b) a means for securing said tubular spindle-core to said buoyant flexible pool cover thereby enabling said cover to fold back upon itself about said spindle-core to be wrapped therearound;

(c) a means for producing rotation to said spindle-core to fold said cover back upon itself about said spindle-core to be wrapped therearound into a roll upon the surface water of the pool.

2. A pool cover rolling apparatus as in claim 1 wherein said tubular spindle-core element comprises:

(a) a first tube body (12*a*) spindle-core element;

(b) a means for securing said first tube body to said cover wherein a second tube body (12*b*) traverses said cover parallel to said first tube body, said first and second tube bodies traverse the top and under surface of said pool cover respectively at a midpoint of said cover and said tube bodies are further connected at at least opposing ends to form the spindle-core (12), whereby together said tube bodies rotate in similar direction about an imaginary third axis folding said cover back upon itself thereby enabling said cover to be wrapped therearound;

(c) means for connecting said first and second tube bodies together at least opposing ends to form said tubular spindle-core element.

3. A pool cover rolling apparatus as in claim 1 wherein said tubular spindle-core element comprises:

(a) a single tubular spindle-core (72), said spindle-core element adapted to be secured to said buoyant flexible pool cover at a midpoint of said cover thereby enabling the cover to be wrapped therearound;

(b) means for securing said single tubular spindle-core to said buoyant flexible pool cover.

4. A pool cover rolling apparatus as in claim 1 wherein said means for producing rotation to said spindle-core is removably connected to at least one end of said spindle-core thereby allowing said spindle-core to reside at water level within the perimeter of the pool when said means for producing rotation is removed.

5. A pool cover rolling apparatus as in claim 3 wherein said single tubular spindle-core is telescopic comprising multiple interlocking members (73) of similar cross-sectional shape, and said means for securing said spindle-core to said cover is a clip (88) of a similar said cross-sectional shape, whereby said shape provides an interlocking of said members, and seating for said clips.

6. A method of rolling and un-rolling a buoyant flexible pool cover directly upon the surface water of the pool, wherein said method comprises:

(a) providing a free-floating apparatus for rolling and un-rolling buoyant flexible pool covers, said apparatus adapted to fit within the perimeter of said pool at water level, said apparatus which is free-floating resides upon said cover at a midpoint of said cover and is solely supported by the buoyancy of said cover, said apparatus comprising a tubular spindle-core element upon which said cover is wrapped therearound, said apparatus further comprising a removable means for producing rotation to said spindle-core;

(b) rolling said pool cover upon the surface water of said pool and within the perimeter of said pool, the operation being assisted by the buoyancy of the cover;

(c) un-rolling said pool cover to a fully extended position.

7. A method of rolling and un-rolling a buoyant flexible pool cover as in claim 6 wherein said method overcomes the restriction of bottlenecks posed by the design of an irregular shaped pool, said method comprising:

(a) segmentation of said cover into multiple cover parts, the segmentation line to be located at the bottleneck posed by the design of the irregular shaped pool, thereby overcoming the restriction said bottleneck poses while drawing said cover upon the surface of the water during the rolling process;

(b) positioning one said spindle-core midpoint each said cover part respectively to roll said part independently upon the surface water of the pool.

8. A method of rolling and un-rolling a buoyant flexible pool cover as in claim 6, wherein said method utilizes a free-floating spindle-core element comprised of a first tube body spindle-core element, and a means for securing said first tube body to said cover wherein a second tube body spindle-core element traverses said pool cover parallel to said first tube body, said first and second tube bodies traverse the top and under surface of said pool cover respectively at a midpoint of said cover and said tube bodies are further connected at least opposing ends to form said free-floating spindle-core element, wherein the step of rolling said pool cover is accomplished by applying an evenly distributed pressure exerted by said first and second tube bodies above and below said cover in similar rotational directions about an imaginary third axis folding said cover back upon itself at a midpoint until said cover is fully rolled.

9. A method of rolling and un-rolling a buoyant flexible pool cover as in claim 6 wherein said method comprises securing a single free-floating tubular spindle-core (72) upon said cover at a midpoint of said cover employing said means for producing rotation to fold the midpoint of said cover back upon itself and upon the surface of the water until said cover is fully rolled.

10. A method of rolling and un-rolling a buoyant flexible pool cover as in claim 6 wherein said method comprises utilizing interlocking spindle-core members (73) to provide a means of adjusting the length of said spindle-core to an appropriate width of the pool within the bounds of the pool edge, wherein the cross-sectional shape of said spindle-core members provides an interlocking of said members, a seating for clips (88), and a receptacle for said means for producing rotation.

11. A combined swimming pool cover and unsupported roll-up device comprising a flexible floatable sheet material covering the water surface of a swimming pool or the like, and an elongated shaft having opposite ends extending laterally of the cover, means attaching said shaft at least at intermittent locations along its length to the sheet material cover such that the shaft and cover combination float on the water surface in a pool-covered mode and winding means removably connected into one end of the shaft suitable to transmit torque to the cover through the entire length of the shaft, the winding means including a manual crank arm and the shaft including means for receiving the crank arm in order to roll the flexible cover on the shaft and whereby the shaft and rolled-up cover can be removed from the water surface in a pool-uncovered mode.

* * * * *